US005513505A

United States Patent [19]

Dancs

[11] Patent Number: 5,513,505

[45] Date of Patent: May 7, 1996

[54] ADJUSTABLE INTERCONNECTED LOCK ASSEMBLY

[75] Inventor: Imre J. Dancs, Greendale, Wis.

[73] Assignee: Master Lock Company, Milwaukee, Wis.

[21] Appl. No.: 112,200

[22] Filed: Aug. 26, 1993

[51] Int. Cl.[6] ..... E05B 59/00

[52] U.S. Cl. ..... 70/107; 70/461; 292/169.13; 292/DIG. 60

[58] Field of Search ..... 70/107, 153, 461, 70/465, 110, 109, 450, 451; 292/169.13, DIG. 60

[56] References Cited

U.S. PATENT DOCUMENTS

| | | | |
|---|---|---|---|
| 170,353 | 11/1875 | Drucklieb . | |
| 536,957 | 4/1895 | Klein | 70/109 |
| 1,066,465 | 7/1913 | Carroll . | |
| 1,152,776 | 9/1915 | Wolfe . | |
| 1,968,285 | 7/1934 | Egan . | |
| 2,046,790 | 7/1936 | Phillips . | |
| 3,107,113 | 10/1963 | Sconzo | 292/DIG. 60 |
| 3,111,020 | 11/1963 | Garcia . | |
| 3,791,180 | 2/1974 | Doyle | 70/107 |
| 3,875,772 | 4/1975 | Ebersman et al. . | |
| 3,881,331 | 5/1975 | Tranberg et al. . | |
| 3,892,110 | 7/1975 | Poli . | |
| 4,011,741 | 3/1977 | Nolin . | |
| 4,037,440 | 7/1977 | Shabtai et al. . | |
| 4,073,527 | 2/1978 | Schlage . | |
| 4,154,070 | 5/1979 | Bahry et al. . | |
| 4,276,760 | 7/1981 | Nolin | 70/110 |
| 4,333,324 | 6/1982 | Dietrich et al. . | |
| 4,418,552 | 12/1983 | Nolin | 70/110 |
| 4,606,203 | 8/1986 | Esser | 70/106 |
| 4,676,083 | 6/1987 | Sedley et al. . | |
| 4,809,526 | 3/1989 | Shen | 70/107 |
| 4,838,053 | 6/1989 | Shen | 70/107 |
| 4,934,800 | 6/1990 | Choi | 292/DIG. 60 |
| 4,979,767 | 12/1990 | Lin | 292/336.3 |
| 5,077,992 | 1/1992 | Su | 70/107 |
| 5,205,596 | 4/1993 | Ralph | 292/336.3 |

*Primary Examiner*—Darnell M. Boucher
*Attorney, Agent, or Firm*—Dorn, McEachran, Jambor & Keating

[57] ABSTRACT

An interconnected lock assembly for use on a door includes a first latch adapted to be positioned in a first bore in the door and a second latch adapted to be positioned in a second bore in the door, spaced from the first bore. There is an outside operating member operably connected to the first latch for causing operation thereof and there is an inside operating member operably connected to the first latch for also causing operation thereof. There is an interconnecting mechanism operably connected to the inside operating member and to the second latch. The interconnecting mechanism is effective to cause operation of the second latch when the first latch is operated by the inside operating member. The interconnecting mechanism is adjustable as to length to accommodate variant spacing between the first and second bores.

8 Claims, 5 Drawing Sheets

ADJUSTABLE INTERCONNECTED LOCK ASSEMBLY

THE FIELD OF THE INVENTION

The present invention relates to an interconnected lock assembly of the type in which an inside handle, either knob or lever, simultaneously retracts both a deadlatch and a deadbolt. Such a lock assembly is commonly found in public accommodations such as hotels and motels in which, for security purposes, the occupant wishes to set both a deadlatch and a deadbolt. The same type of lock assembly may also be found in a residential environment. It is particularly important that both locks be retracted by the turning of a single inside operating member as it has been found that in the event of a fire or other panic situation it is desirable that the occupant only need turn a single knob or lever to operate all of the lock mechanisms in a particular door.

Such interconnected lock assemblies have been on the market for a number of years. The principal disadvantage of currently available products of this type is that there is a fixed distance relationship between the two latch assemblies with the result that door preparation can be difficult if there is a slight misalignment of the latch assembly bores. Further, it is difficult to retrofit an existing door if the distance between bore centerlines is not the same as the distance between the latch assemblies of the interconnected lock. The present invention addresses this problem by providing an interconnected lock assembly in which the distance between the two latch mechanisms comprising the lock assembly is variable and easily adjustable. The increments of adjustment are fine to accommodate slight variation caused by imperfect boring on the part of the installer. Also, the lock mechanism has the ability to provide a very substantial range of adjustment to accommodate a variety of pre-bored door applications.

SUMMARY OF THE INVENTION

The present invention relates to interconnected lock assemblies of the type in which one handle may retract two spaced locks in a single door, and has particular relation to such a lock assembly providing for adjustable spacing between the lock assemblies.

A primary purpose of the invention is to provide an interconnected lock assembly which is simple in construction, reliably operable and provides for a substantial range of adjustment between the spacing of the two lock mechanisms.

Another purpose is an interconnected lock assembly of the type described which provides for fine increments of adjustment to accommodate slight variation caused by imperfect boring in door installation.

Another purpose is to provide an adjustable interconnected lockset to accommodate differences in center-to-center distance between the upper and lower lock assemblies.

Another purpose is an interconnected lock assembly providing for adjustment between the spacing of the lock mechanisms which is easy to install and reliable in operation.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
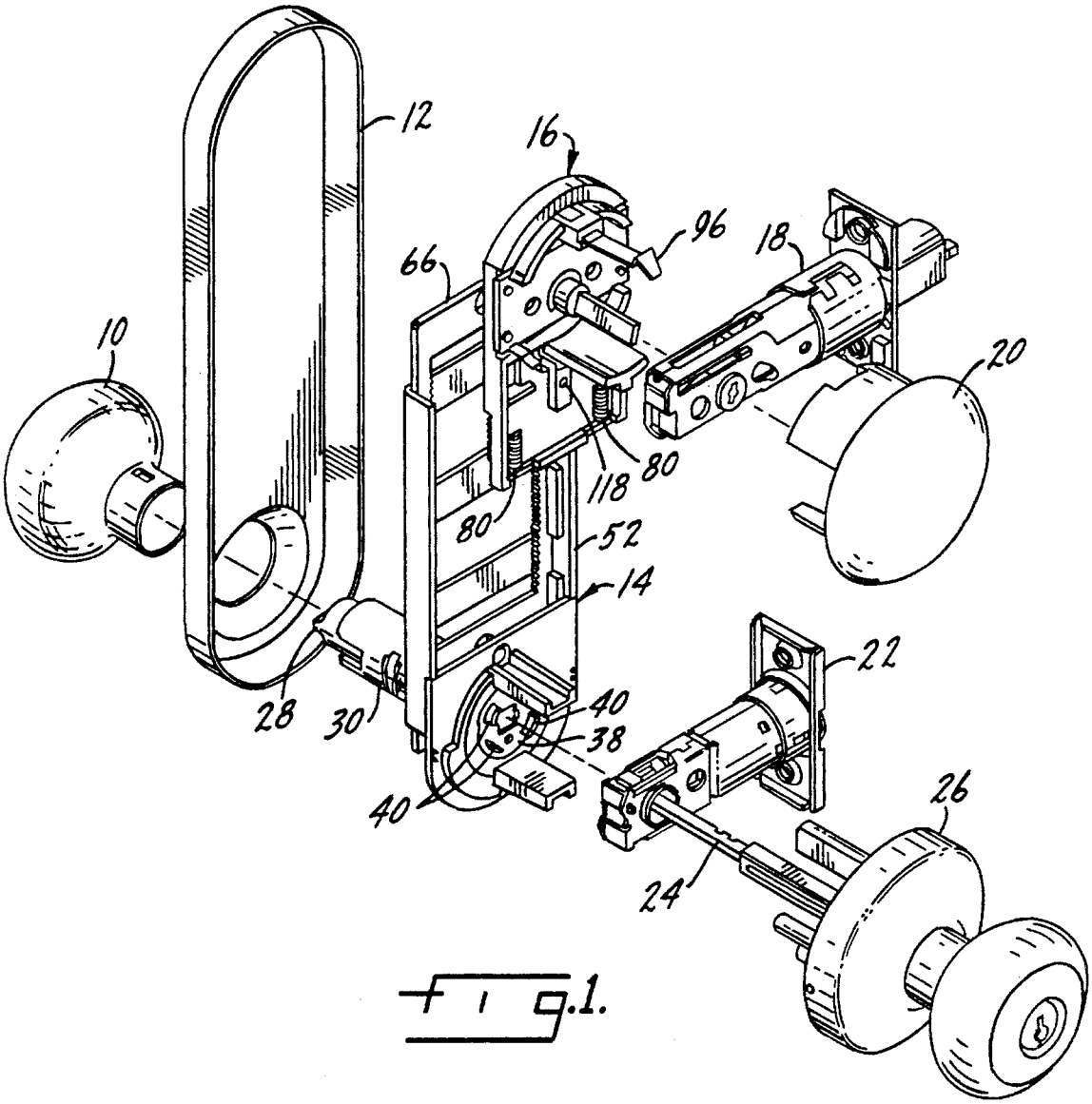
FIG. 1 is an exploded perspective illustrating the interconnected lock assembly of my invention.
Figure 2:
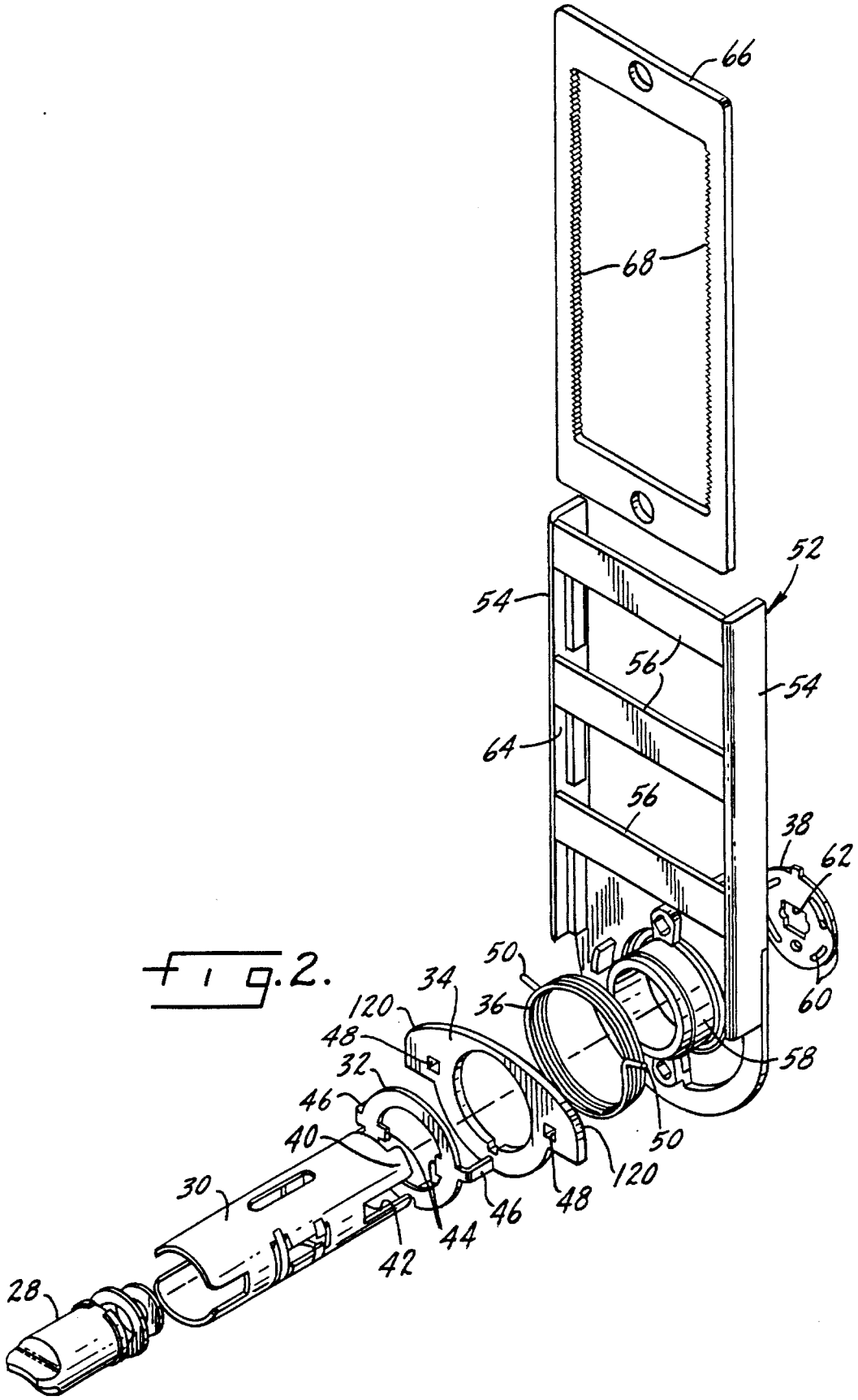
FIG. 2 is an enlarged exploded perspective of the lower interconnected unit.
Figure 3:
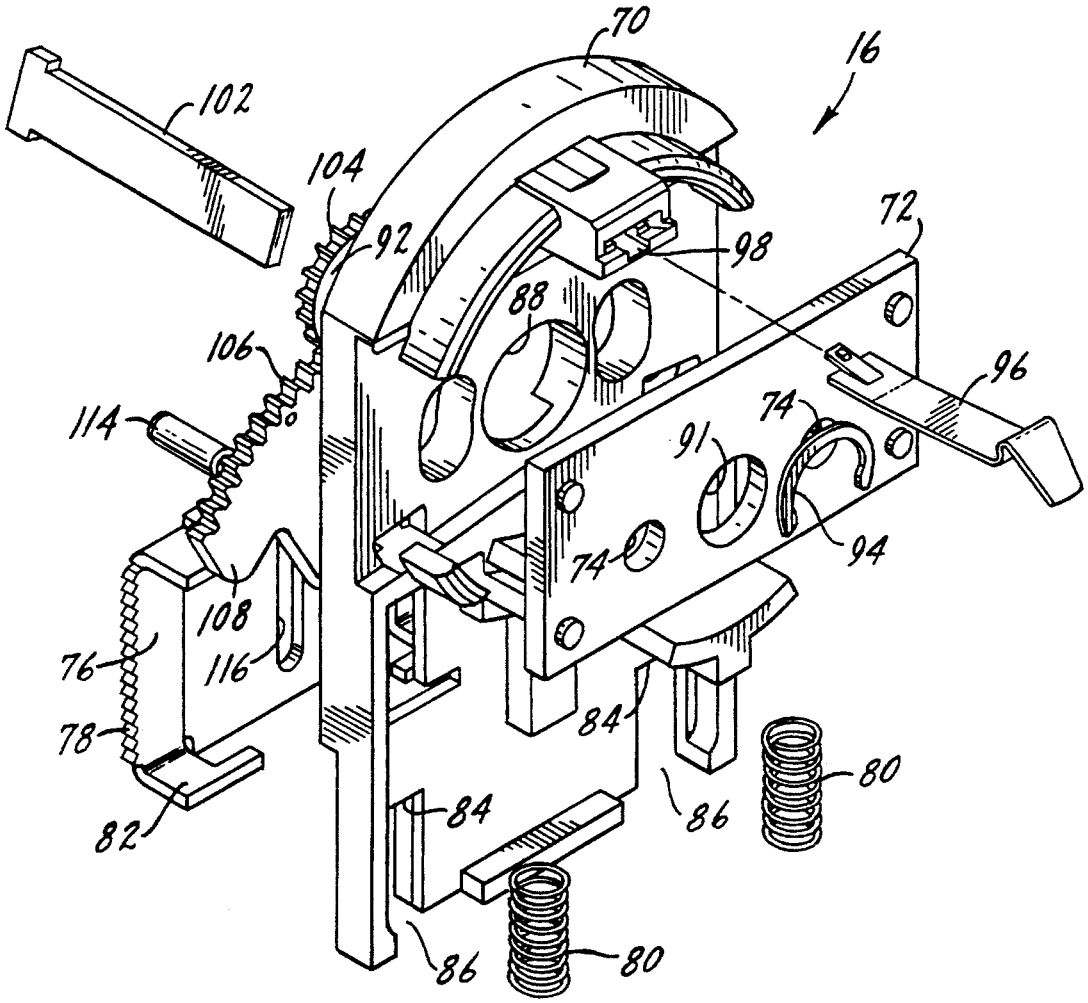
FIG. 3 is an enlarged exploded perspective of one side of the upper interconnected unit.
Figure 4:
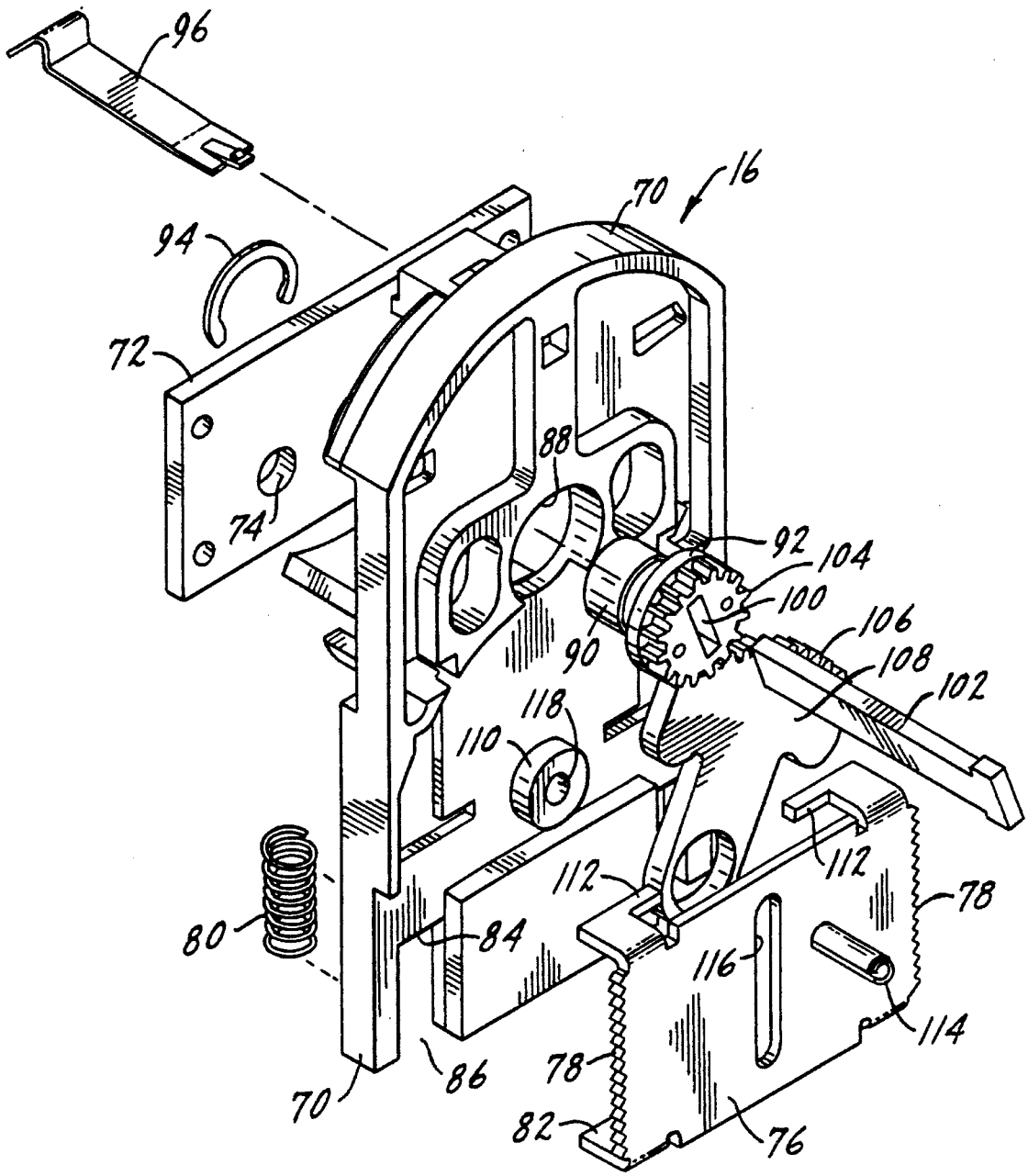
FIG. 4 is an enlarged exploded perspective of the opposite side of the upper interconnected unit.
Figure 5:
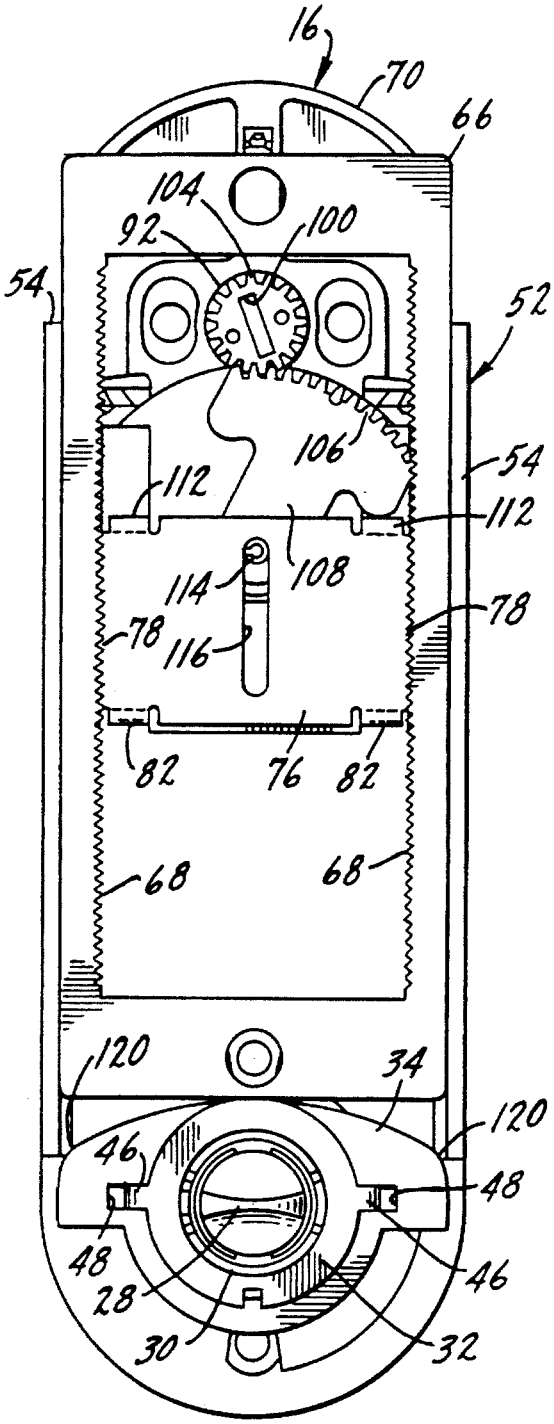
FIG. 5 is a plan view of the interconnected unit in an inoperative position.
Figure 6:
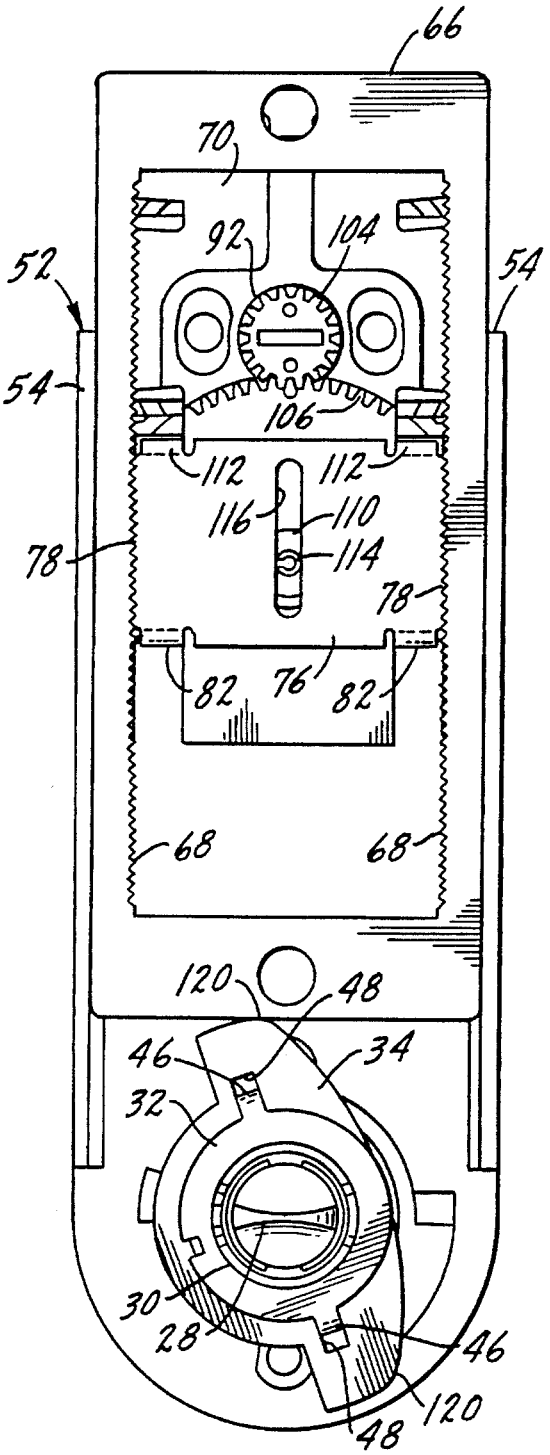
FIG. 6 is a plan view of the interconnected unit in an operative position.

The interconnected lock assembly of the present invention consists of certain basic elements. There is an inside knob 10 which, although shown as a knob may also be a lever, a decorative escutcheon 12, which masks the interconnecting assembly comprising the lower interconnected unit 14 and the upper interconnected unit 16. There is an upper unit latch 18 which in conventional practice will be a typical deadbolt latch. There is an outside upper unit 20 which may either function as a means for mounting the upper interconnected unit 16 or may itself include a standard locking unit such as a cylinder lock or it may be a locking arrangement which is operable by other means, for example, an electrically operated remote control. There is a lower unit latch 22 which may be a conventional deadlatch operated through a spindle 24 extending outwardly from an outside lock assembly 26 which may include a conventional cylinder lock. In normal operation, turning of the inside knob 10 will retract the lower deadlatch 22 and through the interconnecting assembly made up of lower unit 14 and upper unit 16, will also retract the deadbolt 18. The outside knob assembly 26 may similarly turn and retract or lock both the deadlatch and the deadbolt.

The inside knob 10 may have a thumb button assembly 28 extending through an opening thereof to set the lock mechanism. Rotation of knob 10 will turn an inside sleeve 30 which in turn will rotate an inside spring driver 32, a lower unit cam 34, an inside torsion spring 36 and a spindle driver 38. Sleeve 30 has a plurality of axially extending projections 40 separated by axial slots 42. Spring driver 32 has diametrically opposed inwardly directed projections 44 which are positioned in slots 42 to provide the driving connection between the sleeve and the inside spring driver. The spring driver in turn has two axially extending projections 46 which pass through aligned openings 48 in the lower unit cam. The projections 46 also interact with the ends 50 of torsion spring 36 to the end that when the sleeve, spring driver and lower unit cam are turned by knob 10, the torsion spring will return these elements to their original position when the knob is released.

The lower interconnected unit includes a frame 52 comprising a pair of spaced rails 54 and cross members 56. At the lower end of frame 52 there is a cylindrical boss 58 which is effective to mount torsion spring 36, cam 34, spring driver 32 and sleeve 30. The spindle driver 38 has four spaced openings 60 which will receive the axial projections 40 of inside sleeve 30 with the projections being staked to the spindle driver to form a completely factory assembled unit. The spindle driver has a central opening 62 which will receive the spindle 24 so that rotation of the spindle driver by knob 10 will turn the spindle as will rotation of the outside knob assembly 26.

The frame 52 has a slideway 64 within which is positioned a lower unit slide 66. The longitudinal interior edges of slide 66 have a plurality of uniform and closely spaced teeth 68 which will form the driving connection with the upper unit slide to be described.

The upper interconnected unit 16 includes a housing 70 which through the use of an upper unit mounting plate 72 will be fastened to the door. The outside upper unit 20 will receive the fastening members such as screws which will pass through the openings 74 in mounting plate 72 to thereby position and fasten the upper interconnected unit 16 to the door. Both the upper unit 16 and the lower unit 14 will be mounted on the inside of the door and will be covered by the escutcheon plate 12. The spacing between these units is determined by the spacing of the bores which mount the deadbolt 18 and the deadlatch 22. The upper unit housing 70, which will be mounted above the lower unit 14, interconnects with the lower unit through the upper unit slide 76.

Slide 76 has outer edges with a plurality of uniformly and closely spaced teeth 78 which will mesh with the teeth 68 on the lower unit slide 66. Because the teeth are small in dimension they provide for fine adjustment between the upper and lower unit spacing and thus fine adjustment to accommodate slight variance in spacing between the bores for the deadbolt 18 and the deadlatch 22. The distance spanned by the teeth on the upper and lower slides may, for example, provide for a range of adjustment of approximately 3½ to 6½ inches.

The slide 76 will be driven by the slide 66 which in turn will be driven by the cam 34. There are a pair of return springs 80 each of which are mounted on a ledge 82 on the upper unit slide 76 and are each positioned between the ledge and a shoulder 84 at the top of a spring opening 86 formed in the upper unit housing 70. Springs 80 normally urge both slides to the down position which is the position when both of the locks are operated. The slides move up to retract the locks and latches.

The upper unit housing 70 has a central opening 88 which mounts the cylindrical portion 90 of an upper unit pinion gear 92. The cylindrical portion 90 extends through opening 88 and through a similar opening 91 in the mounting plate 72 and the pinion is held in position by a snap ring 94. There is a hands-free spring clip 96 which also snaps into upper unit housing 70 in an opening 98. The spring clip will attach to the outside upper unit 20 to hold these elements together during mounting.

The upper unit pinion gear 92 has an opening 100 which mounts a tail piece 102 which in turn functions as the spindle for operating the deadbolt 18. Rotation of the pinion gear turns the tail piece which in turn retracts or locks the deadbolt. The exterior of the pinion gear 92 has a plurality of gear teeth 104 which mesh with similar size gear teeth 106 on upper unit multiplier gear 108. The multiplier gear rotates on a boss 110 formed on the upper unit housing 70 and will be driven by movement of the upper unit slide and particularly the inwardly directed arms 112 formed on the upper surface thereof. An assembly pin 114 extends through a central opening 116 in the upper unit slide 76 and fits within a central bore 118 in boss 110. The pin 114 provides guidance for slide movement and prevents disassembly of the upper unit slide from the upper unit housing.

As indicated above, the interconnecting mechanism may be operated by either the inside or the outside knob. When operated by the outside knob, the spindle 24 will turn the spindle driver which in turn will cause cam 34 and sleeve 30 to turn. When the unit is operated from the inside, rotation of knob 10 turns sleeve 30 turning the inside spring driver 32, cam 34, torsion spring 36 and the spindle driver 38.

In either instance, rotation of cam 34 causes one of its shoulders 120 to contact the underside of lower unit slide 66. This moves the slide in an upward direction causing slide 76 to move with it. As slide 76 moves in an upward direction, one of the in-turned arms 112 will cause rotation of the upper unit multiplier gear 108 about boss 110. As this gear rotates it turns pinion gear 92 with the result that tail piece 102 will turn causing retraction of the deadbolt. Thus, both the deadlatch and the deadbolt are operated by turning either the inside or the outside knob.

To assemble the interconnected lock assembly, after the bores for the deadbolt and deadlatch have been formed, these units are placed in position. Next, the upper interconnected unit 16 and the outside upper unit 20 are assembled to the door and secured with tie screws through the openings 74. The lower interconnected unit 14 and the outside knob chassis 26 are then installed. The upper unit may pivot to allow for imperfect alignment between the teeth of the two slides. The installer must make sure that the upper and lower slide teeth mesh properly for consistent and reliable operation. After alignment is completed the lower tie screws in the lower unit mounting plate are positioned and screwed home. The decorative cover or escutcheon is then snapped onto the unit and the inside knob or lever is slipped onto the sleeve 30.

Of importance in the invention is the ability to account for variant spacing between the bores for the deadbolt and the deadlatch. The use of a plurality of fine teeth on two interconnected slides provides not only the ability to accommodate variation in bore spacing but also provides the drive mechanism between the handle that turns the deadlatch and the mechanism that operates the deadbolt. The invention should not be limited to this particular configuration for providing for variant spacing between the deadbolt and deadlatch bores. Other constructions may be equally satisfactory. What is important is to provide for such adjustment and to provide a reliable drive between the mechanism which operates the deadlatch and the mechanism which operates the deadbolt.

Alternate means for adjusting the center to center distance between the upper and lower units include a worm screw which may be turned in the appropriate direction at installation to increase the distance between such units, the distance being maintained by the friction preventing undesirable rotation of the worm screw or through a secondary fastening means; a rack and pinion may be used in which at installation the pinion is turned which has the effect of moving one slide with respect to another, thus changing the effective center to center distance between the upper and lower units, the pinion may be spring loaded to maintain the slides in a locked position during operation of the locks; a set screw may be utilized to hold the upper and lower units in any adjusted position, with the screw being threaded through a tapped hole in the upper slide into a slot in the lower unit slide. The above are merely exemplary of possible alternate means to provide for adjustment of the upper and lower units to account for variant spacing between the bores in a door.

Whereas the preferred form of the invention has been shown and described herein, it should be realized that there are many modifications, alterations and substitutions thereto within the scope of the following claims.

The embodiments of the invention in which an exclusive property or privilege is claimed are defined as follows:

1. An interconnected lock assembly for use on a door including a first latch mechanism to be positioned in a first bore in a door, an outside operating member operably connected to said first latch mechanism for causing operation thereof, an inside operating member operably connected to said first latch mechanism for causing operation thereof, a second latch mechanism to be mounted in a second bore in a door which is spaced from said first bore, means for operating said second latch mechanism, an interconnecting assembly connecting said inside operating member and said means for operating said second latch mechanism, said interconnecting assembly including a first slide movable in a path between said first and second bores and in operable engagement with said inside operating member, a second slide movable in the same path as said first slide and operably engaged with said means for operating said second latch mechanism, a gear assembly connecting said second slide and said second latch mechanism, said gear assembly including a multiplier gear driven from said second slide and a pinion gear connected to said second latch mechanism, means for adjustably positioning said first slide relative to said second slide to accommodate variant spacing between said first and second bores, said first slide, in response to movement of said inside operating member, driving said second slide to operate said second latch mechanism simultaneously with operation of said first latch mechanism.

2. The interconnected lock assembly of claim 1 including a spring returned cam in said interconnecting assembly in engagement with said inside operating member and said first slide.

3. The interconnected lock assembly of claim 2 including a sleeve connecting said inside operating member and said spring returned cam, a spindle driver connected to said sleeve, with rotation of said sleeve turning said spring returned cam and said spindle driver to operate simultaneously said first and second latch mechanisms.

4. The interconnected lock assembly of claim 1 wherein each of said slides have a plurality of uniformly spaced teeth performing the adjustable drive connection therebetween.

5. The interconnected lock assembly of claim 4 wherein said interconnecting assembly includes a housing, said path of movement of said slides being defined by said housing.

6. The interconnected lock assembly of claim 1 including spring means normally biasing said first and second drive members toward a position in which said first and second latch mechanisms are in a latched position.

7. The interconnected lock assembly of claim 1 wherein said pinion gear is rotatably mounted in said interconnecting assembly, a tail piece extending from said pinion gear and operably connected to said second latch mechanism.

8. The interconnected lock assembly of claim 1 wherein said second latch mechanism is a deadbolt.

* * * * *